US011598219B2

(12) United States Patent
Nishiyama

(10) Patent No.: US 11,598,219 B2
(45) Date of Patent: Mar. 7, 2023

(54) VALVE DRIVE DEVICE AND STEAM TURBINE SYSTEM

(71) Applicant: MITSUBISHI HEAVY INDUSTRIES COMPRESSOR CORPORATION, Tokyo (JP)

(72) Inventor: Kenichi Nishiyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 108 days.

(21) Appl. No.: 17/153,222

(22) Filed: Jan. 20, 2021

(65) Prior Publication Data

US 2021/0231026 A1 Jul. 29, 2021

(30) Foreign Application Priority Data

Jan. 28, 2020 (JP) ..... JP2020-011809

(51) Int. Cl.
*F01D 17/14* (2006.01)
*F01D 17/26* (2006.01)

(52) U.S. Cl.
CPC ..... *F01D 17/145* (2013.01); *F01D 17/26* (2013.01); *F05D 2220/31* (2013.01); *F05D 2270/64* (2013.01)

(58) Field of Classification Search
CPC .... F01D 17/145; F01D 17/26; F05D 2220/31; F05D 2270/64; F16K 21/06; F16K 21/10; F16K 21/12; F16K 31/1221; F16K 31/1226; F16K 31/163; F16K 31/1635
See application file for complete search history.

(56) References Cited

U.S. PATENT DOCUMENTS

| | | | | |
|---|---|---|---|---|
| 1,950,594 | A * | 3/1934 | Bryant | F01D 17/145 251/23 |
| 2,668,556 | A * | 2/1954 | Meyer | F01D 17/145 91/387 |
| 4,343,454 | A | 8/1982 | Kure-Jensen et al. | |
| 9,638,054 | B2 * | 5/2017 | Katagake | H02K 7/06 |
| 2007/0075285 | A1 | 4/2007 | Lovejoy | |
| 2017/0356532 | A1 | 12/2017 | Tonaka et al. | |

FOREIGN PATENT DOCUMENTS

| | | | |
|---|---|---|---|
| DE | 4227280 | C1 | 8/1993 |
| EP | 2765276 | A1 | 8/2014 |
| JP | 2016-136033 | A | 7/2016 |

* cited by examiner

*Primary Examiner* — David E Sosnowski
*Assistant Examiner* — Jason G Davis
(74) *Attorney, Agent, or Firm* — Osha Bergman Watanabe & Burton LLP

(57) ABSTRACT

A valve drive device includes a hydraulic cylinder that is configured to drive a regulating valve, an actuator that is configured to supply hydraulic oil to the hydraulic cylinder, and a connection pipe through which the hydraulic cylinder with the actuator communicate with each other and the hydraulic oil flows. The hydraulic cylinder includes a cylinder body to which the hydraulic oil is supplied, a piston movable in a central axis direction of the cylinder body by the hydraulic oil supplied to the cylinder body, and a cylinder base on which the cylinder body is placed in a state where the central axis direction is coincident with a vertical direction. The cylinder base has hydraulic oil flow path portion connected to the connection pipe and through which the hydraulic oil flows.

5 Claims, 5 Drawing Sheets

VALVE DRIVE DEVICE AND STEAM TURBINE SYSTEM

BACKGROUND OF THE INVENTION

Field of the Invention

The present disclosure relates to a valve drive device and a steam turbine system.

Priority is claimed on Japanese Patent Application No. 2020-011809, filed on Jan. 28, 2020, the content of which is incorporated herein by reference.

Description of Related Art

A steam turbine includes a casing and a rotor rotated around a rotary shaft by steam fed into the casing from an outside. Japanese Unexamined Patent Application, First Publication No. 2016-136033 discloses a configuration including a regulating valve and a linear motion mechanism for regulating a flow rate of the steam supplied into the casing from the outside. The regulating valve is provided in a steam supply pipe that feeds the steam into the casing from the outside. The linear motion mechanism regulates an opening degree of the regulating valve.

SUMMARY OF THE INVENTION

Incidentally, the regulating valve and the linear motion mechanism are disposed near a suction port of the casing through which the steam is caused to flow into the casing. Therefore, the regulating valve and the linear motion mechanism has a high temperature since heat of the steam introduced into the casing of the steam turbine propagates to the regulating valve and the linear motion mechanism. In particular, the steam flowing through the suction port has an extremely high temperature. Therefore, the regulating valve and the linear motion mechanism are greatly affected by the heat of steam. The linear motion mechanism using a hydraulic cylinder is provided with a sensor or a cable for controlling an operation of the hydraulic cylinder. When being greatly affected by the heat of the steam, there is a possibility that the sensor or the cable may be damaged.

The present disclosure provides a valve drive device and a steam turbine system which can suppress the possibility that a hydraulic cylinder for driving a regulating valve is affected by heat.

According to an aspect of the present disclosure, there is provided a valve drive device that is configured to drive a regulating valve that is configured to regulate a flow rate of steam in a flow path which is configured to supply the steam into a casing of a steam turbine. The valve drive device includes a hydraulic cylinder that is configured to drive the regulating valve, an actuator that is configured to supply hydraulic oil to the hydraulic cylinder, and a connection pipe through which the hydraulic cylinder and the actuator communicate with each other and the hydraulic oil flows. The hydraulic cylinder includes a cylinder body formed in a cylindrical shape and to which the hydraulic oil is supplied, a piston disposed inside the cylinder body and configured to move in a central axis direction of the cylinder body by the hydraulic oil supplied to the cylinder body, and a cylinder base connected to the cylinder body and on which the cylinder body is placed in a state where the central axis direction is coincident with a vertical direction. The cylinder base has a hydraulic oil flow path portion connected to the connection pipe and through which the hydraulic oil flows.

According to another aspect of the present disclosure, there is provided a valve drive device that is configured to drive a regulating valve that is configured to regulate a flow rate of steam in a flow path which is configured to supply the steam into a casing of a steam turbine. The valve drive device includes a hydraulic cylinder that is configured to drive the regulating valve, an actuator that is configured to supply hydraulic oil to the hydraulic cylinder, a connection pipe through which the hydraulic cylinder and the actuator communicate with each other and the hydraulic oil flows, a hydraulic oil supply line that is configured to supply the hydraulic oil to the actuator, a communication pipe connected to the hydraulic oil supply line and communicating with the hydraulic cylinder, and an on-off valve disposed in a connection portion between the hydraulic oil supply line and the communication pipe and configured to switch a supply destination of the hydraulic oil to the hydraulic oil supply line or the communication pipe. The hydraulic cylinder includes a cylinder body formed in a cylindrical shape and to which the hydraulic oil is supplied, and a piston disposed inside the cylinder body and configured to move in a central axis direction of the cylinder body by the hydraulic oil supplied to the cylinder body. The communication pipe communicates with an inside of the cylinder body on a side opposite to a position where the cylinder base is connected to the piston in the central axis direction.

According to the valve drive device and the steam turbine system of the present disclosure, it is possible to suppress the possibility that the hydraulic cylinder for driving the regulating valve is affected by the heat.

DETAILED DESCRIPTION OF THE INVENTION

Figure 1:
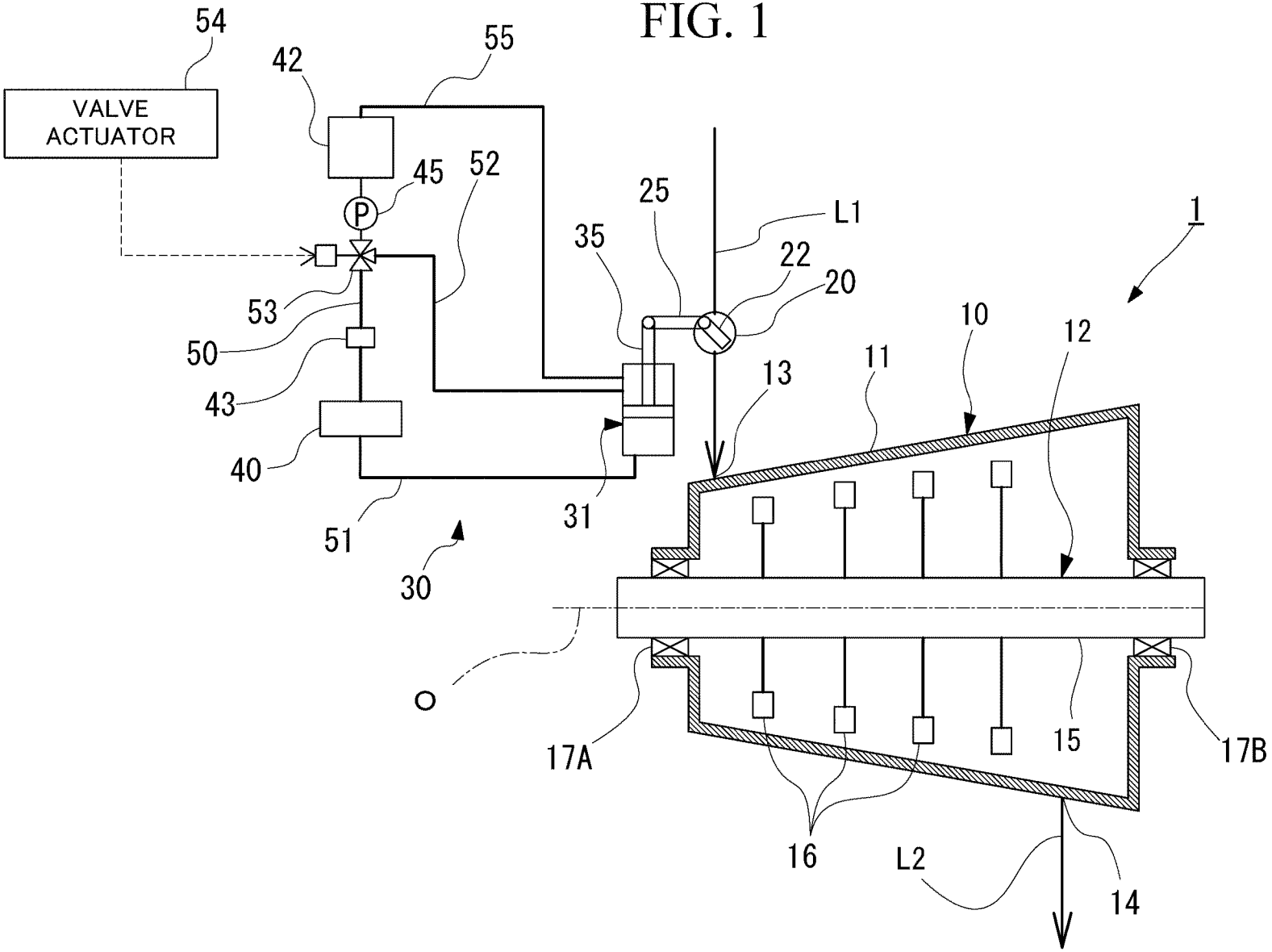
FIG. 1 is a schematic view illustrating a schematic configuration of a steam turbine system according to an embodiment of the present disclosure.

Hereinafter, an embodiment of a valve drive device and a steam turbine system according to the present disclosure will be described with reference to the accompanying drawings. However, the present disclosure is not limited only to the embodiment.

(Configuration of Steam Turbine System)

A steam turbine system 1 mainly includes a steam turbine 10, a regulating valve 20, and a valve drive device 30.

(Configuration of Steam Turbine)

The steam turbine 10 includes a casing 11 and a rotor 12.

The casing 11 has a cylindrical shape extending in a direction of an axis O in which the axis O of the rotor 12 extends. The casing 11 has a suction port 13 and a discharge port 14. The suction port 13 is disposed in one end portion of the casing 11 in the direction of the axis O. A steam supply line L1 through which steam supplied from a steam supply source flows is connected to the suction port 13. The suction port 13 introduces the steam into the casing 11 from an outside of the casing 11 through the steam supply line L1.

The discharge port 14 is disposed in the other end portion of the casing 11 in the direction of the axis O, which is opposite to a position where the suction port 13 is disposed in the direction of the axis O. A steam discharge line L2 that discharges the steam passing through the steam turbine 10 is connected to the discharge port 14. The discharge port 14 discharges the steam flowing inside the casing 11 outward through the steam discharge line L2.

The rotor 12 includes a rotary shaft 15 and rotor blades 16.

The rotary shaft 15 is rotatable around the axis O with respect to the casing 11. Both end portions of the rotary shaft 15 are supported to be rotatable by a first bearing 17A and a second bearing 17B.

A plurality of the rotor blades 16 are disposed at an interval in the direction of the axis O of the rotary shaft 15. Each of the rotor blades 16 is provided on an outer peripheral surface of the rotary shaft 15 to extend outward in a radial direction. The plurality of rotor blades 16 are accommodated inside the casing 11 together with a central portion of the rotary shaft 15.

In this steam turbine 10, the steam generated by a boiler (not illustrated) is introduced into the casing 11 from the suction port 13 via the steam supply line L1. The steam introduced into the casing 11 flows from the suction port 13 side toward the discharge port 14 side. When the steam collides with the rotor blade 16 on each stage of the rotor 12, the rotor blade 16 is driven to rotate around the axis O together with the rotary shaft 15. The steam reaching the discharge port 14 of the casing 11 is discharged outward of the casing 11 through the steam discharge line L2.

(Configuration of Regulating Valve)

The regulating valve 20 is disposed in the steam supply line L1. The regulating valve 20 regulates a flow rate of the steam flowing inside the steam supply line L1 that supplies the steam into the casing 11. The regulating valve 20 includes a valve body 22. An opening area of the regulating valve 20 is regulated by rotating the valve body 22 around a valve axis. In this manner, the regulating valve 20 can increase or decrease a flow path opening area inside the steam supply line L1, and can regulate the flow rate of the steam.

(Configuration of Valve Drive Device)

Figure 2:
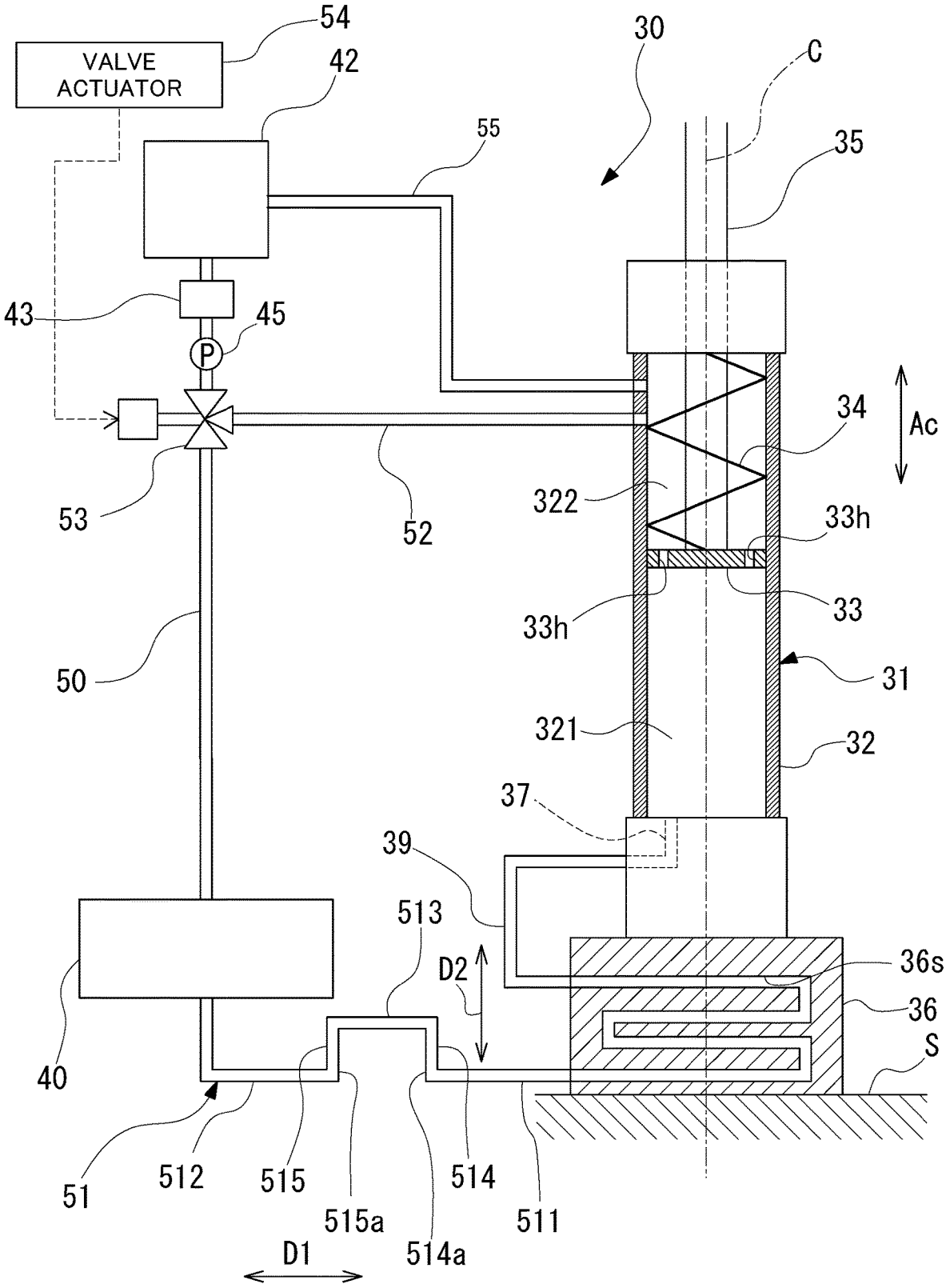
FIG. 2 is a view illustrating a configuration of a valve drive device provided in the steam turbine system.

The valve drive device 30 causes the regulating valve 20 to regulate the opening area. Specifically, the valve drive device 30 drives the valve body 22 of the regulating valve 20 to rotate around the valve axis. As illustrated in FIGS. 1 and 2, the valve drive device 30 mainly includes a hydraulic cylinder 31, an actuator 40, a hydraulic oil supply line 50, a connection pipe 51, a communication pipe 52, an on-off valve 53, and a discharge pipe 55.

(Configuration of Hydraulic Cylinder)

The hydraulic cylinder 31 drives the regulating valve 20. As illustrated in FIG. 2, the hydraulic cylinder 31 includes a cylinder body 32, a piston 33, an elastic member 34, a rod 35, and a cylinder base 36.

The cylinder body 32 is formed in a cylindrical shape formed around a central axis C. Hydraulic oil is supplied into the cylinder body 32 from the actuator 40.

The piston 33 is disposed inside the cylinder body 32. The piston 33 is formed in a plate shape orthogonal to a central axis direction Ac in which the central axis C of the cylinder body 32 extends. An outer peripheral surface of the cylinder body 32 is in sliding contact with an inner peripheral surface of the cylinder body 32. The piston 33 partitions a space inside the cylinder body 32 into a first oil chamber 321 formed on a first side in the central axis direction Ac (end portion side where the rod 35 (to be described later) protrudes from the cylinder body 32) and a second oil chamber 322 formed on a second side in the central axis direction Ac (end portion side where the cylinder base 36 (to be described later) is connected to the cylinder body 32). The piston 33 is movable inside the cylinder body 32 in the central axis direction Ac. The piston 33 changes a size (volume) of the first oil chamber 321 and a size (volume) of the second oil chamber 322 by moving in the central axis direction Ac. The piston 33 moves inside the cylinder body 32 in the central axis direction Ac by the hydraulic oil supplied to the first oil chamber 321 or the second oil chamber 322.

A cylinder communication portion **33*h* is formed in the piston 33. The cylinder communication portion 33*h* communicates with the first oil chamber 321 which is a space on the first side with respect to the piston 33 in the central axis direction Ac and the second oil chamber 322 which is a space on the second side with respect to the piston 33 in the central axis direction Ac, inside the cylinder body 32. In the embodiment of the present disclosure, the cylinder communication portion 33*h* is an orifice formed by a hole penetrating the piston 33 in the central axis direction Ac. Instead of the orifice, the cylinder communication portion 33*h* may be a pipe provided outside the cylinder body 32 and through which the first oil chamber 321 and the second oil chamber 322** communicate with each other.

An inlet 37 is formed in an end portion on the first side of the cylinder body 32 in the central axis direction Ac. The inlet 37 causes the hydraulic oil to flow into the cylinder body 32. The inlet 37 is formed in the cylinder body 32 to communicate with the first oil chamber 321. Therefore, the hydraulic oil flowing from the inlet 37 is supplied to the first oil chamber 321.

The elastic member 34 is disposed on the second side in the central axis direction Ac with respect to the piston 33. The elastic member 34 is accommodated inside the second oil chamber 322. The elastic member 34 biases the piston 33 from the end portion on second side in the central axis direction Ac toward the end portion on the first side in the central axis direction Ac. As the elastic member 34 of the embodiment of the present disclosure, for example, a coil-shaped spring is used.

The rod 35 is connected to the piston 33 on the second side in the central axis direction Ac. The rod 35 extends from the piston 33 in the central axis direction Ac. That is, the rod 35 extends to pass through the second oil chamber 322. The rod 35 protrudes outward of the cylinder body 32 from the end portion on the second side of the cylinder body 32 in the central axis direction Ac. Outside the cylinder body 32, the rod 35 is connected to a drive arm 25 (refer to FIG. 1) for driving the regulating valve 20. The rod 35 moves in the central axis direction Ac together with the piston 33.

The piston 33 moves to the second side in the central axis direction Ac inside the cylinder body 32 so that the rod 35 is pushed outward of the cylinder body 32. In this manner, the valve body 22 is movable via the rod 35 and the drive arm 25 so that the opening degree of the regulating valve 20 increases. In addition, the piston 33 moves to the first side in the central axis direction Ac inside the cylinder body 32 so that the rod 35 is pulled into the cylinder body 32. In this manner, the valve body 22 is movable via the rod 35 and the drive arm 25 so that the opening degree of the regulating valve 20 decreases. That is, the piston 33 and the rod 35 drive the regulating valve 20 by the hydraulic oil supplied into the cylinder body 32.

(Configuration of Cylinder Base)

The cylinder base 36 is connected to an end portion of the cylinder body 32. The cylinder base 36 is disposed in the end portion on the first side of the cylinder body 32 in the central axis direction Ac. The cylinder base 36 enables the cylinder body 32 to be placed on an installation surface S in a state where the central axis direction Ac is coincident with a vertical direction. The installation surface S is a region located near the suction port 13 of the casing 11 and affected by the steam flowing into the steam turbine 10 to have a high temperature. For example, the installation surface S may be a region on the casing 11 or a region away from the casing 11. In addition, the state where the central axis direction Ac is coincident with the vertical direction does not mean only a state where the central axis C extends straight in the vertical direction, and includes a state where the central axis C is tilted with respect to the vertical direction.

A hydraulic oil flow path portion 36*s* is formed inside the cylinder base 36. A first end which is one end portion of the hydraulic oil flow path portion 36*s* is connected to the inlet 37 via a cylinder connection pipe 39. The cylinder connection pipe 39 is a pipe through which the hydraulic oil flow path portion 36*s* and the inlet 37 communicate with each other. A connection pipe 51 (to be described later) is connected to a second end which is the other end portion of the hydraulic oil flow path portion 36*s*. The hydraulic oil flow path portion 36*s* causes the connection pipe 51 and the inside of the cylinder body 32 to communicate with each other. The hydraulic oil supplied from the actuator 40 via the connection pipe 51 flows through the hydraulic oil flow path portion 36*s*.

(Configuration of Actuator)

The actuator 40 supplies the hydraulic oil to the hydraulic cylinder 31. The hydraulic oil is supplied to the actuator 40 from a tank 42 for storing the hydraulic oil through the hydraulic oil supply line 50 by a boosting pump 45. A cooler 43 is provided in the hydraulic oil supply line 50. The cooler 43 cools the hydraulic oil supplied from the tank 42 by the boosting pump 45. The actuator 40 supplies the hydraulic oil supplied from the tank 42 by the boosting pump 45 to the hydraulic cylinder 31 via the connection pipe 51 (to be described later).

(Configuration of Connection Pipe)

The connection pipe 51 causes the hydraulic cylinder 31 and the actuator 40 to communicate with each other. The connection pipe 51 is a pipe that connects the cylinder base 36 and the actuator 40 to each other. The hydraulic oil flows inside the connection pipe 51. The connection pipe 51 is connected to the cylinder base 36 to communicate with the hydraulic oil flow path portion 36*s*. That is, the connection pipe 51 communicates with the first oil chamber 321 on the first side of the piston 33 in the central axis direction Ac, inside the cylinder body 32.

When the hydraulic oil is fed into the first oil chamber 321 of the hydraulic cylinder 31 from the actuator 40 via the connection pipe 51, the amount of the hydraulic oil increases inside the first oil chamber 321. In this manner, the piston 33 is pushed to the first side in the central axis direction Ac against a biasing force of the elastic member 34. That is, the piston 33 and the rod 35 move so that a volume of the first oil chamber 321 increases. In addition, the hydraulic oil flows into the connection pipe 51 even when the hydraulic oil returns from the hydraulic cylinder 31 to the actuator 40. When the hydraulic oil returns from the hydraulic cylinder 31 to the actuator 40, the amount of the hydraulic oil decreases inside the first oil chamber 321. In this manner, the piston 33 is pushed to the second side in the central axis direction Ac by the biasing force of the elastic member 34. That is, the piston 33 and the rod 35 move so that the volume of the second oil chamber 322 increases. The hydraulic oil discharged from the first oil chamber 321 is discharged outward through a drain line (not illustrated) connected to the actuator 40 via the cylinder connection pipe 39, the hydraulic oil flow path portion 36*s*, and the connection pipe 51.

Figure 3:
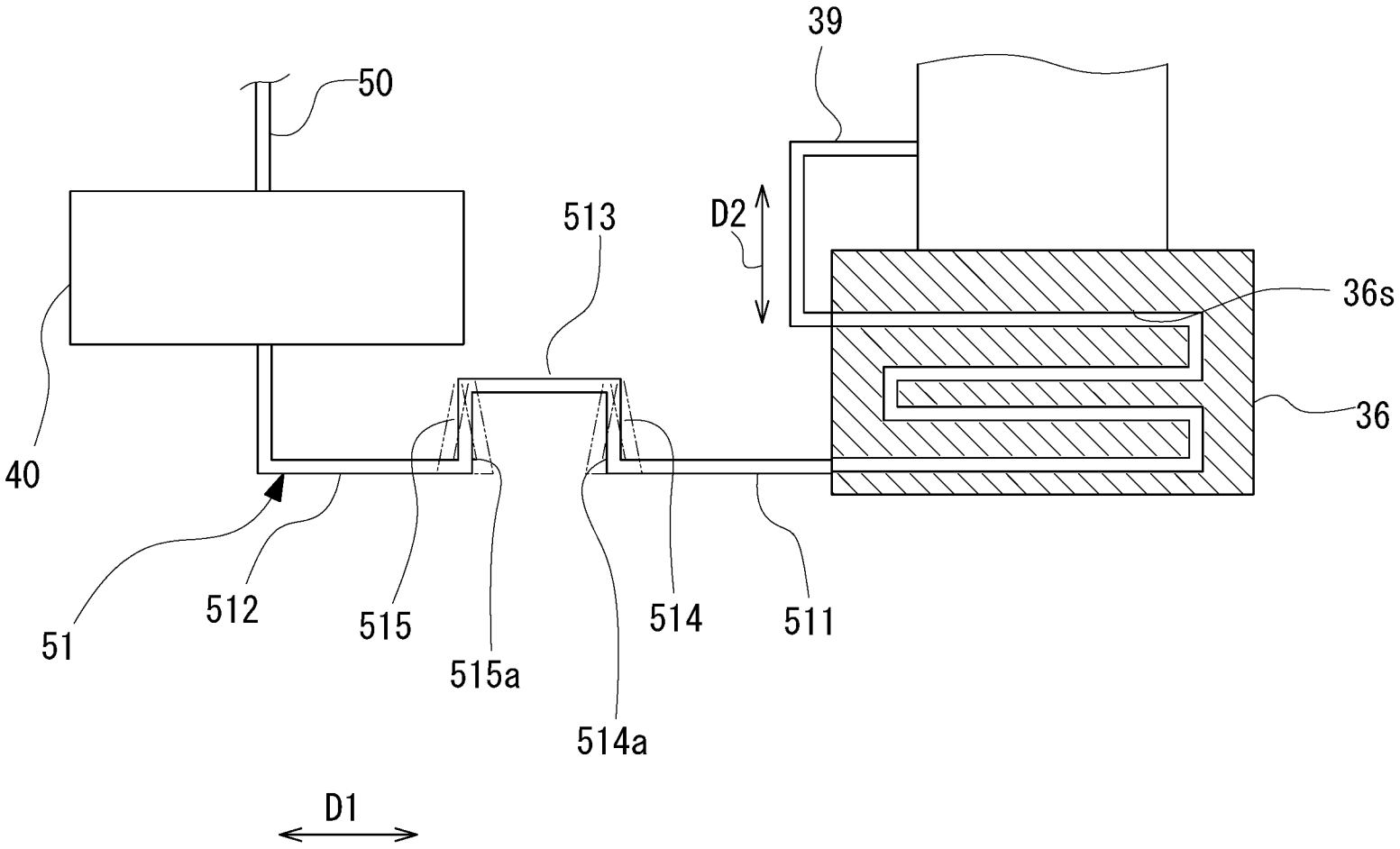
FIG. 3 is a view illustrating a configuration of a connection pipe of the valve drive device.

As illustrated in FIG. 3, the connection pipe 51 includes a cylinder side extension portion 511, an actuator side extension portion 512, an intermediate extension portion 513, a first connection portion 514, and a second connection portion 515.

The cylinder side extension portion 511 is connected to the cylinder base 36. The cylinder side extension portion 511 extends in a first direction D1 which is a direction connecting the cylinder base 36 and the actuator 40 to each other.

The actuator side extension portion 512 is connected to the actuator 40. The actuator side extension portion 512 extends in the first direction D1. The cylinder side extension portion 511 and the actuator side extension portion 512 coaxially extend. The cylinder side extension portion 511 and the actuator side extension portion 512 are separated from each other in the first direction D1.

The intermediate extension portion 513 is disposed at a position between the cylinder side extension portion 511 and the actuator side extension portion 512. The intermediate extension portion 513 is provided at a position deviated in a second direction D2 which is a direction intersecting with the first direction D1. The intermediate extension portion 513 extends in the first direction D1. In the present embodiment, the first direction D1 is the horizontal direction, and the second direction D2 is the vertical direction orthogonal to the first direction D1.

The first connection portion 514 is connected to an end portion of the intermediate extension portion 513 on a side close to the cylinder base 36. The first connection portion 514 extends in the second direction D2. The first connection portion 514 is connected to an end portion of the cylinder side extension portion 511 on a side which is not connected to the cylinder base 36. That is, the first connection portion 514 connects the intermediate extension portion 513 and the cylinder side extension portion 511 to each other.

The second connection portion 515 is connected to an end portion of the intermediate extension portion 513 on a side close to the actuator 40. That is, the second connection portion 515 is disposed at a position opposite to the first connection portion 514 across the intermediate extension portion 513 in the first direction D1. The second connection portion 515 extends in the second direction D2 to be parallel to the first connection portion 514. The second connection portion 515 is connected to an end portion of the actuator side extension portion 512 on a side which is not connected to the actuator 40. That is, the second connection portion 515 connects the intermediate extension portion 513 and the actuator side extension portion 512 to each other.

The cylinder side extension portion 511, the actuator side extension portion 512, the intermediate extension portion 513, the first connection portion 514, and the second connection portion 515 do not respectively have an expansion and contraction mechanism in the extending direction (pipe axial direction), and are formed of a metal pipe having low flexibility.

In the connection pipe 51, the cylinder side extension portion 511 and the actuator side extension portion 512 deform due to expansion and contraction in the first direction D1 in response to the influence of heat from the casing 11. Consequently, as illustrated by a two-dot chain line in FIG. 3, the first connection portion 514 is connected to the intermediate extension portion 513 and the cylinder side extension portion 511 so that a connection angle with respect to the intermediate extension portion 513 and the cylinder side extension portion 511 is changed in response to expansion and contraction of the cylinder side extension portion 511 in the first direction D1. That is, the connection portion between the first connection portion 514 and the cylinder side extension portion 511 and the connection portion between the first connection portion 514 and the intermediate extension portion 513 are configured so that the connection angle is widened or narrowed from 90°. Similarly, the second connection portion 515 is connected to the intermediate extension portion 513 and the actuator side extension portion 512 so that the connection angles with respect to the intermediate extension portion 513 and the actuator side extension portion 512 is changed in response to expansion and contraction of the actuator side extension portion 512 in the first direction D1. That is, the connection portion between the second connection portion 515 and the actuator side extension portion 512 and the connection portion between the second connection portion 515 and the intermediate extension portion 513 are configured so that the connection angle is widened or narrowed from 90°.

(Configuration of Discharge Pipe)

As illustrated in FIG. 2, the discharge pipe 55 connects the cylinder body 32 and the tank 42 to each other. The discharge pipe 55 is a pipe through which the second oil chamber 322 and the inside of the tank 42 communicate with each other. The hydraulic oil discharged from the second oil chamber 322 flows through the discharge pipe 55. Therefore, the hydraulic oil in the second oil chamber 322 returns to the tank 42 via the discharge pipe 55.

(Configuration of Communication Pipe)

The communication pipe 52 is connected to the hydraulic oil supply line 50 so that the hydraulic oil supply line 50 is intermediately branched. The communication pipe 52 communicates with the inside of the cylinder body 32 on a side opposite to a position where the cylinder base 36 is connected to the piston 33 in the central axis direction Ac. Therefore, the communication pipe 52 communicates with the inside of the cylinder body 32 on a side opposite to the connection pipe 51 in the central axis direction Ac with respect to the piston 33. That is, the communication pipe 52 communicates with the second oil chamber 322 on the second side in the central axis direction Ac with respect to the piston 33.

Figure 4:
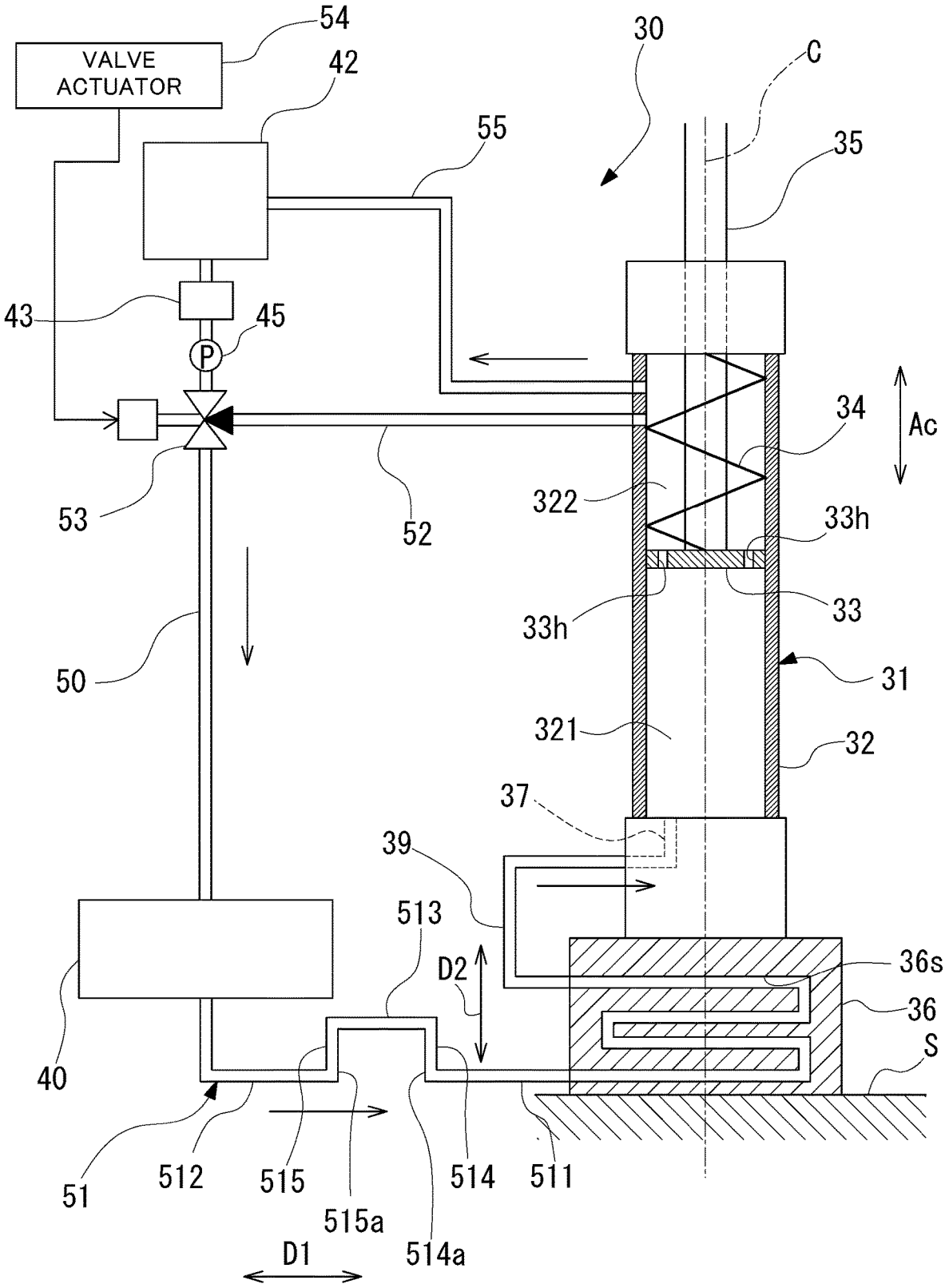
FIG. 4 is a view illustrating a flow of hydraulic oil in a state where the hydraulic oil is supplied from an actuator to a hydraulic cylinder in order to regulate an opening degree of a regulating valve in the valve drive device.
Figure 5:
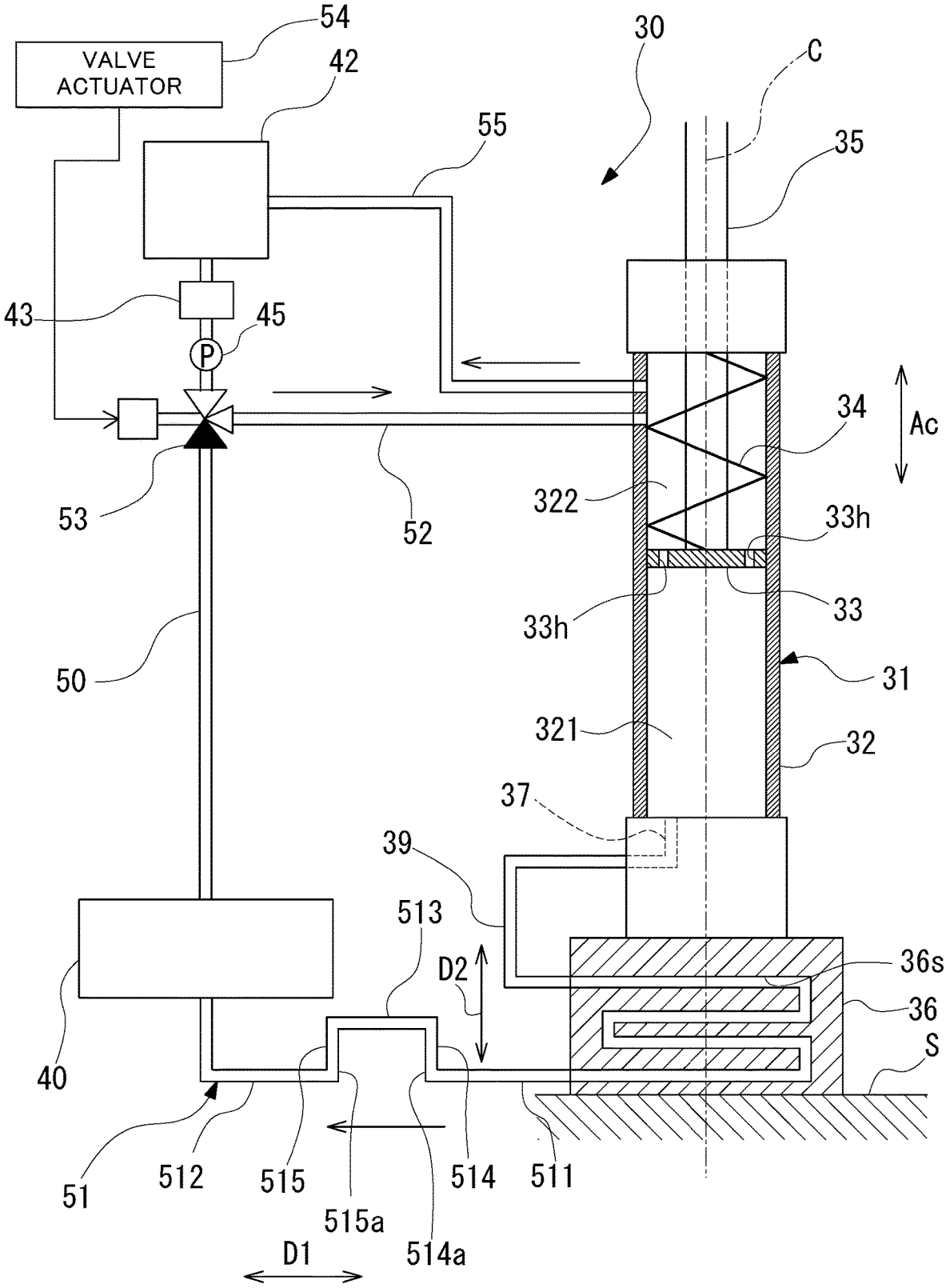
FIG. 5 is a view illustrating a flow of the hydraulic oil in a state where the regulating valve is closed in the valve drive device.

The on-off valve 53 is disposed in a connection portion between the communication pipe 52 and the hydraulic oil supply line 50. The on-off valve 53 can switch a supply destination of the hydraulic oil to the hydraulic oil supply line 50 or the communication pipe 52. In the embodiment of the present disclosure, the on-off valve 53 is a three-way valve using a solenoid valve. The on-off valve 53 includes a valve actuator 54 that switches operations of opening and closing the on-off valve 53. As illustrated in FIG. 4, the on-off valve 53 normally causes the tank 42 and the actuator 40 to communicate with each other, and blocks the communication pipe 52. When a signal for switching the on-off valve 53 is input to the valve actuator 54 from a control device that controls the whole steam turbine 10, as illustrated in FIG. 5, the on-off valve 53 causes the tank 42 and the communication pipe 52 to communicate with each other, and blocks the hydraulic oil supply line 50 leading to the actuator 40.

(Operation of Valve Drive Device)

In the valve drive device 30 as described above, the hydraulic oil supply line 50 is normally opened by the on-off valve 53. Therefore, the hydraulic oil is supplied to the actuator 40 through the hydraulic oil supply line 50. In this state, when the opening degree of the regulating valve 20 is increased, in the valve drive device 30, as illustrated in FIG. 4, the hydraulic oil is supplied from the inlet 37 into the first oil chamber 321 through the connection pipe 51, the hydraulic oil flow path portion **36*s* of the cylinder base 36, and the cylinder connection pipe 39 from the actuator 40. In this manner, the rod 35 moves to the second side in the central axis direction Ac together with the piston 33 so that the second oil chamber 322 is narrowed. As a result, the opening degree of the regulating valve 20** increases.

As described above, the hydraulic oil is supplied from the actuator 40 to operate the hydraulic cylinder 31. In this manner, when the opening degree of the valve body 22 of the regulating valve 20 reaches a predetermined opening degree, the supply of the hydraulic oil from the actuator 40 is stopped.

In addition, when the opening degree of the regulating valve 20 is decreased, the valve drive device 30 stops the supply of the hydraulic oil from the actuator 40. In this case, due to self-weights of the piston 33, the rod 35, and a member connected to the rod 35 and the biasing force of the elastic member 34, the piston 33 moves to the first side in the central axis direction Ac so that the first oil chamber 321 is narrowed. As a result, the opening degree of the regulating valve 20 decreases. At this time, the hydraulic oil pushed out from the first oil chamber 321 through the inlet 37 by the movement of the piston 33 is discharged outward through a drain line (not illustrated) connected to the actuator 40 via the cylinder connection pipe 39, the hydraulic oil flow path portion **36*s*, and the connection pipe 51**.

In addition, when the operation of the steam turbine 10 is stopped for some reasons, a signal for stopping the supply of the hydraulic oil to the hydraulic cylinder 31 is input to the actuator 40 from a control device (not illustrated) of the steam turbine 10. In this manner, the piston 33 moves to the first side in the central axis direction Ac inside the cylinder body 32 due to the self-weights of the piston 33, the rod 35, and the member connected to the rod 35 and the biasing force of the elastic member 34.

In addition, when the regulating valve 20 is immediately closed as in a case when the steam turbine 10 is stopped in an emergency, a signal for switching open and closed states of the on-off valve 53 is input to the valve actuator 54 from the control device (not illustrated) of the steam turbine 10. When a predetermined signal is input from the control device, the valve actuator 54 switches the on-off valve 53 having the three-way valve using the solenoid valve so that the communication pipe 52 is opened and the hydraulic oil supply line 50 is blocked. In this manner, as illustrated in FIG. 5, the hydraulic oil is directly supplied into the second oil chamber 322 from the tank 42 through the on-off valve 53 and the communication pipe 52 without passing through the actuator 40. As a result, the piston 33 is pushed by the hydraulic oil, and moves to the first side in the central axis direction Ac. In this way, the piston 33 moves due to the hydraulic oil directly fed into the second oil chamber 322 in addition to the self-weight of the piston 33 and the rod 35, and the biasing force of the elastic member 34. In this manner, the rod 35 quickly moves to the first side in the central axis direction Ac together with the piston 33, and the regulating valve 20 is quickly closed.

(Operational Effect)

In the valve drive device 30 having the above-described configuration, the cylinder body 32 is installed on the installation surface S via the cylinder base 36. The cylinder base 36 has the hydraulic oil flow path portion 36*s* through which the hydraulic oil supplied from the actuator 40 to the cylinder body 32 via the connection pipe 51 can flow. The heat of the steam flowing into the steam turbine 10 propagates to the cylinder body 32 via the cylinder base 36. However, the hydraulic oil flows through the hydraulic oil flow path portion 36*s*. Accordingly, even when the heat of the steam propagates to the cylinder base 36, the cylinder base 36 is cooled by the hydraulic oil. Therefore, the heat propagating to the cylinder body 32 via the cylinder base 36 can be suppressed. Therefore, it is possible to suppress the possibility that the heat of the steam propagates to a sensor or a cable (not illustrated) provided in the cylinder body 32. As a result, it is possible to suppress the possibility that the hydraulic cylinder 31 for driving the regulating valve 20 is affected by the heat.

In addition, the connection pipe 51 supplies the hydraulic oil only to the first oil chamber 321 located on the first side of the piston 33 in the central axis direction Ac, inside the cylinder body 32. According to the configuration in which the hydraulic oil is supplied only to the first oil chamber 321 by the connection pipe 51, when the regulating valve 20 is closed, the hydraulic oil is discharged to the actuator 40 from the first oil chamber 321 through the hydraulic oil flow path portion 36*s* and the connection pipe 51. When the hydraulic oil flow path portion 36*s* is formed in the cylinder base 36 in this way, the flow path of the hydraulic oil is lengthened between the actuator 40 and the inside of the cylinder body 32. Therefore, when the steam turbine 10 is stopped in an emergency, there is a possibility that the stop may hinder quick closing of the regulating valve 20. In contrast, there is provided the communication pipe 52 communicating with the second oil chamber 322 located on the second side of the piston 33 inside the cylinder body 32. Therefore, when the on-off valve 53 is opened, the hydraulic oil is directly supplied to the second oil chamber 322 through the communication pipe 52. In this manner, the moving speed of the piston 33 moving from the second side to the first side increases inside the cylinder body 32. Therefore, the regulating valve 20 can be quickly closed.

In addition, the piston 33 has the cylinder communication portion 33*h* through which the first oil chamber 321 and the second oil chamber 322 communicate with each other. A portion of the hydraulic oil inside the cylinder body 32 flows between the first oil chamber 321 and the second oil chamber 322 through the cylinder communication portion 33*h*. In this manner, circulation of the hydraulic oil is promoted. Therefore, the cooling effect of the hydraulic oil can be improved, and it is possible to suppress the possibility that the temperature of the hydraulic oil increases due to the heat of the steam. Therefore, in this regard, it is also possible to suppress the possibility that the temperature of the cylinder body 32 increases.

In addition, when the heat of the steam propagates to the connection pipe 51, the cylinder side extension portion 511 or the actuator side extension portion 512 deforms due to expansion and contraction in the first direction D1 in response to the temperature. However, in the connection pipe 51 of the present embodiment, the connection angle of the first connection portion 514 and the second connection portion 515 is changed. As a result, the connection portion 514*a* on the cylinder side extension portion 511 side of the first connection portion 514 and the connection portion 515*a* on the actuator side extension portion 512 side of the second connection portion 515 deform to be close to or away from each other in the first direction D1. In this manner, it is possible to absorb thermal elongation of the connection pipe 51 which is caused by the influence of the heat. As a result, it is possible to suppress the possibility that the actuator 40 is affected by the influence of the thermal elongation of the connection pipe 51 and the possibility that the connection pipe 51 is damaged.

According to the steam turbine system 1 as described above, it is possible to suppress the possibility that the hydraulic cylinder 31 for driving the regulating valve 20 is affected by the heat. As a result, it is possible to provide the steam turbine system 1 including the valve drive device 30 which is unlikely to fail without being affected by the heat of the steam.

APPENDIX

The valve drive device 30 and the steam turbine system 1 according to the embodiment can be recognized as follows, for example.

(1) According to a first aspect, there is provided the valve drive device 30 that is configured to drive the regulating valve 20 that is configured to regulate the flow rate of the steam in the flow path which is configured to supply the steam into the casing 11 of the steam turbine 10. The valve drive device 30 includes the hydraulic cylinder 31 that is configured to drive the regulating valve 20, the actuator 40 that is configured to supply the hydraulic oil to the hydraulic cylinder 31, and the connection pipe 51 through which the hydraulic cylinder 31 and the actuator 40 communicate with each other and the hydraulic oil flows. The hydraulic cylinder 31 includes the cylinder body 32 formed in the cylindrical shape and to which the hydraulic oil is supplied, the piston 33 disposed inside the cylinder body 32 and movable in the central axis direction Ac of the cylinder body 32 by the hydraulic oil supplied to the cylinder body 32, and the cylinder base 36 connected to the cylinder body 32 and on which the cylinder body 32 is placed in a state where the central axis direction Ac is coincident with the vertical direction. The cylinder base 36 has the hydraulic oil flow path portion 36*s* connected to the connection pipe 51 and through which the hydraulic oil flows.

According to the valve drive device 30, the heat of the steam flowing into the steam turbine 10 propagates to the cylinder body 32 via the cylinder base 36. However, the hydraulic oil flows through the hydraulic oil flow path portion 36*s*. Accordingly, even when the heat of the steam propagates to the cylinder base 36, the cylinder base 36 is cooled by the hydraulic oil. Therefore, the heat propagating to the cylinder body 32 via the cylinder base 36 can be suppressed. Therefore, it is possible to suppress the possibility that the heat of the steam propagates to a sensor or a cable provided in the cylinder body 32. As a result, it is possible to suppress the possibility that the hydraulic cylinder 31 for driving the regulating valve 20 is affected by the heat.

(2) According to a second aspect, the valve drive device 30 may further include the hydraulic oil supply line 50 that is configured to supply the hydraulic oil to the actuator 40, the communication pipe 52 connected to the hydraulic oil supply line 50 and communicating with the inside of the cylinder body 32 on the side opposite to the position where the cylinder base 36 is connected to the piston 33 in the central axis direction Ac, the on-off valve 53 disposed in the connection portion between the hydraulic oil supply line 50 and the communication pipe 52 and configured to switch the supply destination of the hydraulic oil to the hydraulic oil supply line 50 or the communication pipe 52.

As the on-off valve 53, for example, the three-way valve using the solenoid valve may be adopted.

In the configuration in which the connection pipe 51 supplies the hydraulic oil only to one side (cylinder base 36 side) in the central axis direction Ac, inside the cylinder body 32, when the regulating valve 20 is closed, the hydraulic oil is discharged to the actuator 40 from the inside of the cylinder body 32 through the hydraulic oil flow path portion 36*s* and the connection pipe 51. When the hydraulic oil flow path portion 36*s* is formed in the cylinder base 36 in this way, the flow path of the hydraulic oil is lengthened between the actuator 40 and the inside of the cylinder body 32. Therefore, when the steam turbine 10 is stopped in an emergency, there is a possibility that the stop may hinder quick closing of the regulating valve 20. In contrast, in the central axis direction Ac, the communication pipe 52 communicating with the inside of the cylinder body 32 is provided on the side opposite to the position where the cylinder base 36 is connected to the piston 33. Therefore, when the on-off valve 53 is opened, the hydraulic oil is directly supplied to the side on which the piston 33 is moved to close the regulating valve 20 inside the cylinder body 32 through the communication pipe 52. In this manner, the moving speed of the piston 33 moving to close the regulating valve 20 increases inside the cylinder body 32. Therefore, the regulating valve 20 can be quickly closed.

(3) In the valve drive device 30 according to a third aspect, the valve drive device 30 according (1) or (2) may further include the cylinder communication portion 33*h* through which the space on the first side in the central axis direction Ac with respect to the piston 33 in the cylinder body 32 and the space on the second side opposite to the first side communicate with each other.

As the cylinder communication portion 33*h*, an orifice formed by a hole penetrating the piston 33 or a pipe provided outside the cylinder body 32 to cause the first side and the second side of the piston 33 to communicate with each other may be adopted.

In this manner, a portion of the hydraulic oil inside the cylinder body 32 flows between the space on the first side and the space on the second side through the cylinder communication portion 33*h*. In this manner, circulation of the hydraulic oil is promoted. Therefore, a cooling effect of the hydraulic oil can be improved, and it is possible to suppress the possibility that the temperature of the hydraulic oil increases due to the heat of the steam. Therefore, it is also possible to suppress the possibility that the temperature of the cylinder body 32 increases.

(4) In the valve drive device 30 according to a fourth aspect, in the valve drive device 30 according to any one of (1) to (3), the connection pipe 51 includes the cylinder side extension portion 511 connected to the cylinder base 36 and extending in the first direction D1 connecting the cylinder base 36 and the actuator 40 to each other, the actuator side extension portion 512 connected to the actuator 40 and extending in the first direction D1, the intermediate extension portion 513 disposed at the position between the cylinder side extension portion 511 and the actuator side extension portion 512, and the position deviated in the second direction D2 intersecting with the first direction D1 from the cylinder side extension portion 511 and the actuator side extension portion 512, and extending in the first direction D1, the first connection portion 514 extending in the second direction D2 and connected the end portion of the intermediate extension portion 513 and the end portion of the cylinder side extension portion 511 to each other, and second connection portion 515 disposed at the position opposite to the first connection portion 514 across the intermediate extension portion 513 in the first direction D1, extending in the second direction D2, and connected the end portion of the intermediate extension portion 513 and the end portion of the actuator side extension portion 512 to each other. The first connection portion 514 is connected to the intermediate extension portion 513 and the cylinder side extension portion 511 so that the connection angle with respect to the intermediate extension portion 513 and the cylinder side extension portion 511 is changed in response to expansion and contraction of the cylinder side extension portion 511 in the first direction D1. The second connection portion 515 is connected to the intermediate extension portion 513 and the actuator side extension portion 512 so that the connection angle with respect to the intermediate extension portion 513 and the actuator side extension portion 512 is changed in response to expansion and contraction of the actuator side extension portion 512 in the first direction D1.

In this manner, when the heat of the steam propagates to the connection pipe 51, the cylinder side extension portion 511 and the actuator side extension portion 512 deform due to expansion and contraction in the first direction D1 in response to the temperature. However, in the connection pipe 51, the connection angle of the first connection portion 514 and the second connection portion 515 is changed. As a result, the connection portion on the cylinder side extension portion 511 side of the first connection portion 514 and the connection portion on the actuator side extension portion 512 side of the second connection portion 515 deform to be close to or away from each other in the first direction D1. In this manner, it is possible to absorb thermal elongation of the connection pipe 51 which is caused by the influence of the heat. As a result, it is possible to suppress the possibility that the actuator 40 is affected by the influence of the thermal elongation of the connection pipe 51 and the possibility that the connection pipe 51 is damaged.

(5) According to a fifth aspect, there is provided the valve drive device 30 that is configured to drive the regulating valve 20 that is configured to regulate the flow rate of the steam in the flow path which is configured to supply the steam into the casing 11 of the steam turbine 10. The valve drive device 30 includes the hydraulic cylinder 31 that is configured to drive the regulating valve 20, the actuator 40 that is configured to supply the hydraulic oil to the hydraulic cylinder 31, the connection pipe 51 through which the hydraulic cylinder 31 and the actuator 40 communicate with each other and the hydraulic oil flows, the hydraulic oil supply line 50 that is configured to supply the hydraulic oil to the actuator 40, the communication pipe 52 connected to the hydraulic oil supply line 50 and communicating with the hydraulic cylinder 31, and the on-off valve 53 disposed in the connection portion between the hydraulic oil supply line 50 and the communication pipe 52 and configured to switch the supply destination of the hydraulic oil to the hydraulic oil supply line 50 or the communication pipe 52. The hydraulic cylinder 31 includes the cylinder body 32 formed in the cylindrical shape and to which the hydraulic oil is supplied, and the piston 33 disposed inside the cylinder body 32 and configured to move in the central axis direction Ac of the cylinder body 32 by the hydraulic oil supplied to the cylinder body 32. The communication pipe 52 communicates with the inside of the cylinder body 32 on the side opposite to the connection pipe 51 with respect to the piston 33 in the central axis direction Ac.

(6) According to a sixth aspect, there is provided the steam turbine system 1 including the valve drive device 30 according to any one of (1) to (5) and the steam turbine 10.

In this manner, it is possible to suppress the possibility that the hydraulic cylinder 31 for driving the regulating valve 20 is affected by the heat. As a result, it is possible to provide the steam turbine system 1 including the valve drive device 30 which is unlikely to fail without being affected by the heat of the steam.

EXPLANATION OF REFERENCES

1: steam turbine system
10: steam turbine
11: casing
12: rotor
13: suction port
14: discharge port
15: rotary shaft
16: rotor blade
17A: first bearing
17B: second bearing
20: regulating valve
22: valve body
25: drive arm
30: valve drive device
31: hydraulic cylinder
32: cylinder body
321: first oil chamber
322: second oil chamber
33: piston
33*h*: cylinder communication portion
34: elastic member
35: rod
36: cylinder base
36*s*: hydraulic oil flow path portion
37: inlet
39: cylinder connection pipe
40: actuator
42: tank
43: cooler
45: boosting pump
50: hydraulic oil supply line
51: connection pipe
511: cylinder side extension portion
512: actuator side extension portion
513: intermediate extension portion
514: first connection portion
514*a*: connection portion
515: second connection portion
515*a*: connection portion
52: communication pipe
53: on-off valve
54: valve actuator
55: discharge pipe
Ac: central axis direction
C: central axis
D1: first direction
D2: second direction
L1: steam supply line
L2: steam discharge line
O: axis

What is claimed is:

1. A valve drive device that is configured to drive a regulating valve that is configured to regulate a flow rate of steam in a flow path which is configured to supply the steam into a casing of a steam turbine, the valve drive device comprising:

a hydraulic cylinder that is configured to drive the regulating valve;

an actuator that is configured to supply hydraulic oil to the hydraulic cylinder; and a connection pipe through which the hydraulic cylinder and the actuator communicate with each other and the hydraulic oil flows, wherein the hydraulic cylinder includes a cylinder body formed in a cylindrical shape and to which the hydraulic oil is supplied, a piston disposed inside the cylinder body and configured to move in a central axis direction of the cylinder body by the hydraulic oil supplied to the cylinder body, and a cylinder base connected to the cylinder body and on which the cylinder body is placed in a state where the central axis direction is coincident with a vertical direction, the valve drive device further comprises:

a hydraulic oil supply line that is configured to supply the hydraulic oil to the actuator;

a communication pipe connected to the hydraulic oil supply line and communicating with an inside of the cylinder body on a side opposite to a position where the cylinder base is connected to the piston in the central axis direction; and an on-off valve disposed in a connection portion between the hydraulic oil supply line and the communication pipe and configured to switch a supply destination of the hydraulic oil to the hydraulic oil supply line or the communication pipe, and the cylinder base has a hydraulic oil flow path portion connected to the connection pipe and through which the hydraulic oil flows.

2. The valve drive device according to claim 1, further comprising: a cylinder communication portion through which a space on a first side in the central axis direction with respect to the piston in the cylinder body and a space on a second side opposite to the first side communicate with each other.

3. The valve drive device according to claim 1, wherein the connection pipe includes a cylinder side extension portion connected to the cylinder base and extending in a first direction connecting the cylinder base and the actuator to each other, an actuator side extension portion connected to the actuator and extending in the first direction, an intermediate extension portion disposed at a position between the cylinder side extension portion and the actuator side extension portion, and at a position deviated in a second direction intersecting with the first direction from the cylinder side extension portion and the actuator side extension portion, and extending in the first direction, a first connection portion extending in the second direction and connecting a first end portion of the intermediate extension portion to an end portion of the cylinder side extension portion, and a second connection portion disposed at a position opposite to the first connection portion across the intermediate extension portion in the first direction, extending in the second direction, and connecting a second end portion of the intermediate extension portion to an end portion of the actuator side extension portion, the first connection portion is connected to the intermediate extension portion and the cylinder side extension portion so that a connection angle with respect to the intermediate extension portion and the cylinder side extension portion is changed in response to expansion and contraction of the cylinder side extension portion in the first direction, and the second connection portion is connected to the intermediate extension portion and the actuator side extension portion so that a connection angle with respect to the intermediate extension portion and the actuator side extension portion is changed in response to expansion and contraction of the actuator side extension portion in the first direction.

4. A steam turbine system comprising:

the valve drive device according to claim 1; and the steam turbine.

5. A valve drive device that is configured to drive a regulating valve that is configured to regulate a flow rate of steam in a flow path which is configured to supply the steam into a casing of a steam turbine, the valve drive device comprising:

a hydraulic cylinder that is configured to drive the regulating valve;

an actuator that is configured to supply hydraulic oil to the hydraulic cylinder;

a connection pipe through which the hydraulic cylinder and the actuator communicate with each other and the hydraulic oil flows;

a hydraulic oil supply line that is configured to supply the hydraulic oil to the actuator;

a communication pipe connected to the hydraulic oil supply line and communicating with the hydraulic cylinder; and an on-off valve disposed at a connection portion between the hydraulic oil supply line and the communication pipe and configured to switch a supply destination of the hydraulic oil to the hydraulic oil supply line or the communication pipe, wherein the hydraulic cylinder includes a cylinder body formed in a cylindrical shape and to which the hydraulic oil is supplied, and a piston disposed inside the cylinder body and configured to move in a central axis direction of the cylinder body by the hydraulic oil supplied to the cylinder body, and the communication pipe communicates with an inside of the cylinder body on a side opposite to the connection pipe with respect to the piston in the central axis direction.

* * * * *